US009289648B2

(12) United States Patent
Watterson

(10) Patent No.: US 9,289,648 B2
(45) Date of Patent: Mar. 22, 2016

(54) TREADMILL WITH DECK VIBRATION

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 148 days.

(21) Appl. No.: 13/948,045

(22) Filed: Jul. 22, 2013

(65) Prior Publication Data

US 2014/0024500 A1 Jan. 23, 2014

Related U.S. Application Data

(60) Provisional application No. 61/674,483, filed on Jul. 23, 2012.

(51) Int. Cl.

| | |
|---|---|
| ***A63B 22/00*** | (2006.01) |
| ***A63B 22/02*** | (2006.01) |
| ***A63B 71/00*** | (2006.01) |
| ***A63B 23/04*** | (2006.01) |
| ***A63B 23/12*** | (2006.01) |
| ***A63B 21/00*** | (2006.01) |
| *A63B 24/00* | (2006.01) |

(52) U.S. Cl.

CPC ..... *A63B 22/02* (2013.01); *A63B 21/00196* (2013.01); *A63B 22/0023* (2013.01); *A63B 23/0458* (2013.01); *A63B 23/1236* (2013.01); *A63B 24/0087* (2013.01)

(58) Field of Classification Search

CPC ..... A63B 22/00; A63B 22/0015; A63B 22/0023; A63B 22/06; A63B 22/0605; A63B 22/08; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 2022/0271; A63B 2022/0278

USPC ..... 482/51, 54, 57–65

See application file for complete search history.

(56) References Cited

U.S. PATENT DOCUMENTS

| | | | | | |
|---|---|---|---|---|---|
| 3,205,888 | A * | 9/1965 | Stroop | A61H 15/00 | 482/54 |
| 4,917,376 | A * | 4/1990 | Lo | A63B 21/157 | 482/59 |
| 4,925,183 | A * | 5/1990 | Kim | A63B 22/16 | 434/61 |
| 4,958,832 | A * | 9/1990 | Kim | A63B 22/16 | 482/54 |
| 5,081,991 | A * | 1/1992 | Chance | A01K 15/02 | 119/700 |
| 5,137,501 | A | 8/1992 | Merstedor | | |
| 5,431,612 | A * | 7/1995 | Holden | A63B 21/157 | 482/54 |
| 5,533,951 | A * | 7/1996 | Chang | A63B 22/02 | 198/841 |

(Continued)

*Primary Examiner* — Oren Ginsberg
*Assistant Examiner* — Garrett Atkinson
(74) *Attorney, Agent, or Firm* — Holland & Hart LLP

(57) ABSTRACT

A treadmill includes a support structure and a treadbase connected thereto. The treadbase has first and second opposing side rails extending along at least a portion of first and second sides of the treadbase, respectively. A deck is connected to and between the first and second opposing side rails. Front and rear pulleys are connected to and between the first and second opposing side rails. A continuous belt is trained around and rotatable about the front and rear pulleys. One or more vibration assemblies are connected to the deck and selectively create vibrations to cause the deck to vibrate. The vibrations are transferred to a user during the performance of exercise to provide various physiological benefits to the user.

16 Claims, 8 Drawing Sheets

(56) References Cited

U.S. PATENT DOCUMENTS 5,709,632 A * 1/1998 Socwell ..... A63B 22/0012 482/51
5,989,161 A * 11/1999 Wang ..... A63B 22/0221 482/51
6,186,290 B1 2/2001 Carlson
6,712,737 B1 * 3/2004 Nusbaum ..... A63B 69/16 482/57
6,918,859 B1 7/2005 Yeh
7,166,067 B2 * 1/2007 Talish ..... A61H 1/001 482/148
7,322,948 B2 1/2008 Talish et al.
7,402,145 B1 * 7/2008 Woggon ..... A61H 1/005 601/49
7,594,878 B1 * 9/2009 Joannou ..... A61H 1/005 482/54
7,682,287 B1 3/2010 Hsieh
7,871,355 B2 1/2011 Yeh
8,002,684 B2 * 8/2011 Laurent ..... A61H 1/005 482/142
8,012,067 B2 * 9/2011 Joannou ..... A61H 1/005 482/54
2002/0142890 A1 10/2002 Ohrt et al.
2003/0073545 A1 * 4/2003 Liu ..... A63B 22/0235 482/54
2004/0067833 A1 * 4/2004 Talish ..... A61H 1/001 482/148
2006/0287161 A1 12/2006 Dalebout et al.
2007/0142183 A1 * 6/2007 Chang ..... A61H 1/001 482/54
2007/0149363 A1 * 6/2007 Wang ..... A63B 22/0235 482/54
2007/0190508 A1 8/2007 Dalton
2007/0270726 A1 * 11/2007 Chou ..... A61H 23/0263 601/70
2007/0298937 A1 * 12/2007 Shah ..... A63B 22/02 482/54
2008/0020907 A1 * 1/2008 Lin ..... A61H 1/005 482/54
2008/0032871 A1 * 2/2008 Yeh ..... A63B 21/0023 482/54
2008/0139370 A1 6/2008 Charnitski
2008/0207407 A1 * 8/2008 Yeh ..... A63B 22/025 482/54
2008/0214971 A1 * 9/2008 Talish ..... A61H 1/005 601/23
2008/0279896 A1 11/2008 Heinen et al.
2009/0053682 A1 2/2009 Stern
2009/0118098 A1 5/2009 Yeh
2009/0221405 A1 * 9/2009 Wang ..... A63B 21/00196 482/54
2009/0221407 A1 9/2009 Hauk et al.
2010/0087298 A1 4/2010 Zaccherini
2010/0184568 A1 * 7/2010 Schippers ..... A61H 1/003 482/51
2010/0210418 A1 8/2010 Park
2010/0311552 A1 * 12/2010 Sumners ..... A61H 23/0263 482/111
2012/0088640 A1 4/2012 Wissink et al.

* cited by examiner

TREADMILL WITH DECK VIBRATION

CROSS-REFERENCE TO RELATED APPLICATIONS

This applications claim priority to U.S. Provisional Patent Application No. 61/674,483 filed on Jul. 23, 2012.

TECHNICAL FIELD

This disclosure relates generally to systems, methods, and devices for exercise. More particularly, the disclosure relates to a treadmill with a vibrating deck.

BACKGROUND

Physical exercise provides exercisers with numerous benefits, including aerobic conditioning, strength enhancement, weight loss, and rehabilitation. These benefits can be realized through various types of exercise, including walking, running, pushups, squats, and the like. Additionally, recent research indicates that vibration therapy can also provide numerous benefits. Such benefits can include improved muscle strength and performance, increased bone density, stamina, flexibility, mobility, and coordination, enhanced critical blood flow throughout the body, relief of aches and pains, enhanced explosive strength, accelerated weight loss, decreased cortisol levels, increased production of serotonin and neurothrophine, and improved injury recovery.

Various devices have been developed to vibrate a person's body in an effort to realize the above noted benefits of vibration therapy. There have also been efforts made to incorporate vibration into exercise devices. U.S. Pat. Nos. 3,205,888, 4,958,832, 6,918,859, 7,166,067, 7,322,948, 7,871,355, U.S. Patent Publication No. 2007/0190508, U.S. Patent Publication No. 2008/0207407, U.S. Patent Publication No. 2008/0214971, U.S. Patent Publication No. 2008/0279896, U.S. Patent Publication No. 2009/0118098, U.S. Patent Publication No. 2010/0210418, and U.S. Patent Publication No. 2010/0311552 disclose examples of such vibration devices.

SUMMARY OF THE INVENTION

In one example embodiment of the disclosure, a treadmill includes a support structure and a treadbase connected thereto. The treadbase has first and second opposing side rails extending along at least a portion of first and second sides of the treadbase, respectively. A deck is connected to and between the first and second opposing side rails. Front and rear pulleys are also connected to and between the first and second opposing side rails. A continuous belt is trained around and rotatable about the front and rear pulleys. One or more vibration assemblies are connected to the deck and selectively create vibrations to cause the deck to vibrate.

In another aspect that may be combined with any of the aspects herein, one or more vibration assemblies comprise a first vibration assembly and a second vibration assembly.

In another aspect that may be combined with any of the aspects herein, a first vibration assembly is connected to a deck adjacent a first side of a treadbase about midway between first and second ends of the treadbase In another aspect that may be combined with any of the aspects herein, a second vibration assembly is connected to a deck adjacent a second side of a treadbase about midway between first and second ends of the treadbase.

In another aspect that may be combined with any of the aspects herein, one or more isolators are connected between first and second opposing side rails and a deck to limit the transfer of vibrations from the deck to the first and second opposing side rails.

In another aspect that may be combined with any of the aspects herein, at least one of one or more isolators comprises a bore extending at least partially therethrough.

In another aspect that may be combined with any of the aspects herein, a guide pin extends from a deck and into a bore of an isolator.

In another aspect that may be combined with any of the aspects herein, one or more vibration assemblies are connected to a deck between one or more isolators and a continuous belt.

In another aspect that may be combined with any of the aspects herein, at least one of one or more vibration assemblies comprises a motor, a shaft rotatable by the motor about an axis of rotation, and one or more eccentric weights mounted on the shaft.

In another aspect that may be combined with any of the aspects herein, each of one or more eccentric weights comprises a center of mass that is offset from an axis of rotation.

In another aspect that may be combined with any of the aspects herein, rotation of a shaft about an axis of rotation causes the centers of mass of one or more eccentric weights to revolve around the axis of rotation, thereby creating vibrations.

In another aspect that may be combined with any of the aspects herein, an intensity or frequency of vibrations may be selectively controlled by adjusting a speed at which the centers of mass of one or more eccentric weights revolve around an axis of rotation.

In another aspect that may be combined with any of the aspects herein, a control panel has one or more user inputs.

In another aspect that may be combined with any of the aspects herein, a control panel is in electrical communication with one or more vibration assemblies such that the one or more vibration assemblies are controllable by activating one or more user inputs on the control panel.

In another aspect that may be combined with any of the aspects herein, an intensity or frequency of vibrations is related to a speed at which a continuous belt rotates about front and rear pulleys.

In another aspect that may be combined with any of the aspects herein, a treadbase is selectively movable between a plurality of inclined positions.

In another aspect that may be combined with any of the aspects herein, a plurality of inclined positions comprises a declined position, a neutral position, and an inclined position.

In another aspect that may be combined with any of the aspects herein, an intensity or frequency of vibrations is related to an inclined position of a treadbase.

In another aspect that may be combined with any of the aspects herein, one or more vibration assemblies comprise four vibration assemblies.

In another aspect that may be combined with any of the aspects herein, each of four vibration assemblies is connected adjacent to a corner of a deck.

In another aspect that may be combined with any of the aspects herein, one or more vibration assemblies comprise a vibration assembly connected to an underside of a deck near the center of the deck.

In another aspect that may be combined with any of the aspects herein, a treadmill comprises a support structure, a control panel mounted on the support structure, and a treadbase connected to the support structure.

In another aspect that may be combined with any of the aspects herein, a treadbase has a first end, a second end, a first side, and a second side.

In another aspect that may be combined with any of the aspects herein, an intensity or frequency of vibrations created by one or more vibration assemblies is related to at least one of a speed of the continuous belt or an incline level of the treadbase.

In another aspect that may be combined with any of the aspects herein, one or more vibration assemblies comprise a first vibration assembly connected to a deck adjacent a first side of a treadbase about midway between first and second ends of the treadbase.

In another aspect that may be combined with any of the aspects herein, one or more vibration assemblies comprise a second vibration assembly connected to a deck adjacent a second side of a treadbase about midway between first and second ends of the treadbase.

In another aspect that may be combined with any of the aspects herein, at least one of one or more vibration assemblies is connected to a deck with a bracket.

In another aspect that may be combined with any of the aspects herein, at least one of one or more vibration assemblies comprises a rotating cam that periodically engages a deck.

DETAILED DESCRIPTION

Figure 1:
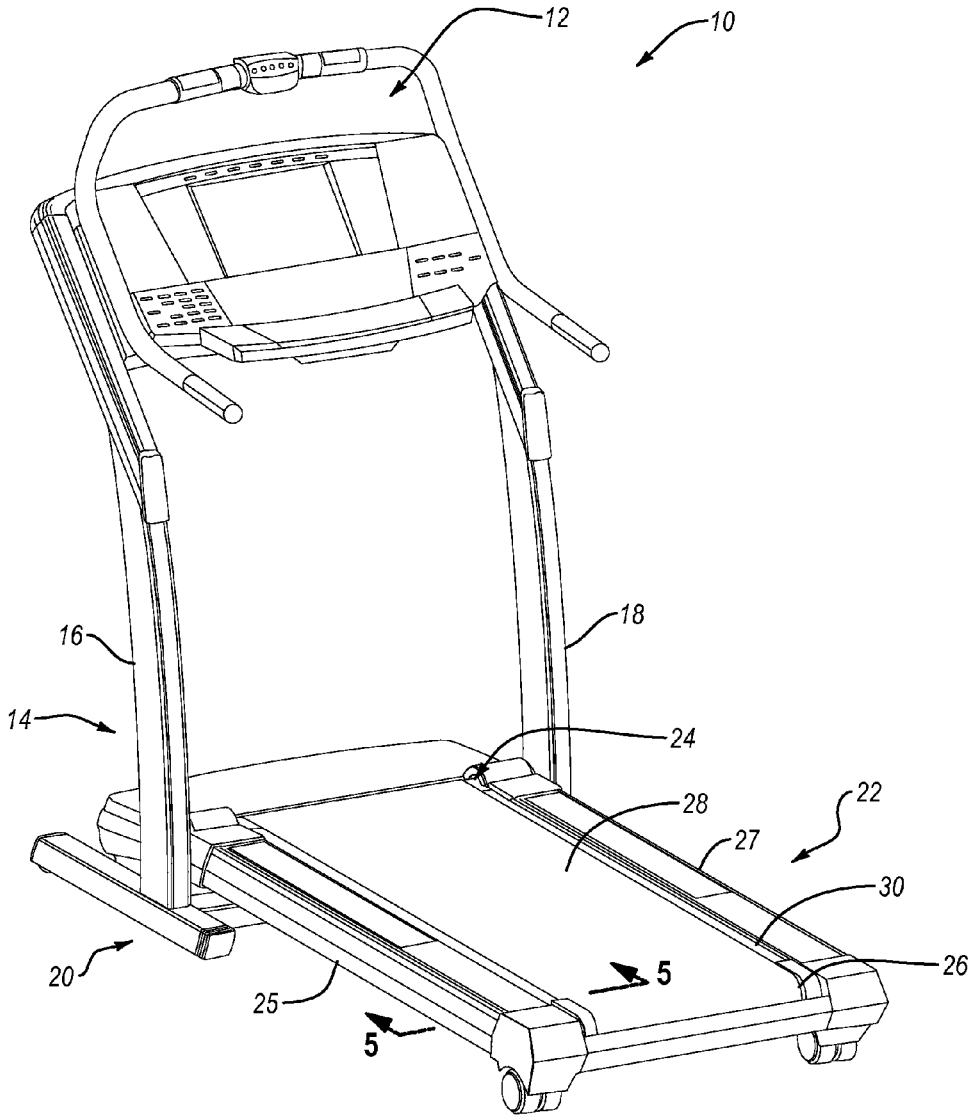
FIG. 1 illustrates a perspective view of an exercise device according to one example embodiment of the present invention.
Figure 2:
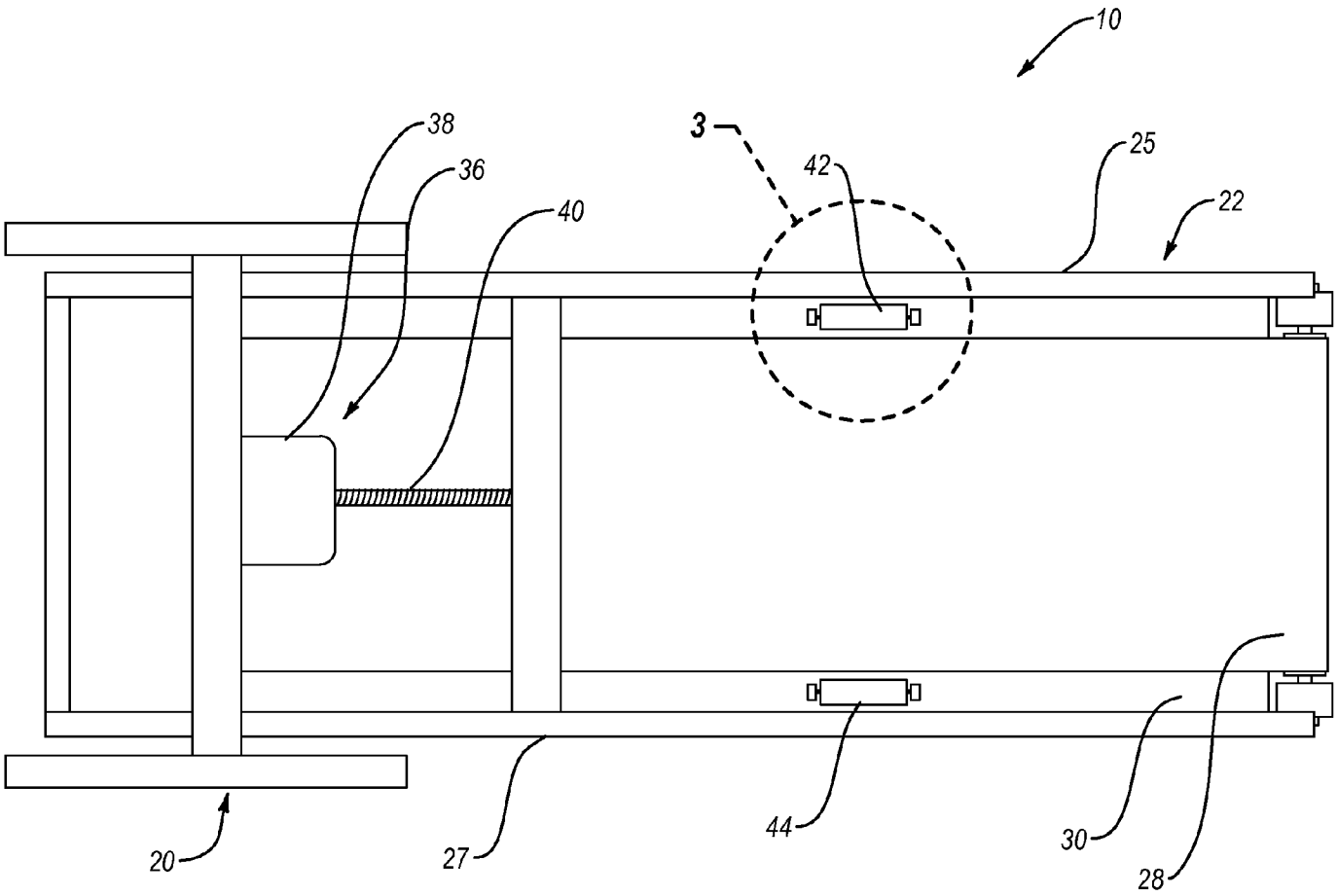
FIG. 2 is a bottom view of the exercise device of FIG. 1.

The present disclosure is directed to systems, methods, and devices for exercise. Depicted in FIGS. 1 and 2 is a representation of one illustrative exercise device 10, which may incorporate the novel features of the present invention, including various novel devices, functionalities, hardware and software modules, and the like. As shown in FIG. 1, exercise device 10 is depicted as a treadmill and includes a console or control panel 12 supported on a generally upright support structure 14. Upright support structure 14, in this illustrated embodiment, includes two side members 16, 18 connected to a base frame 20. Side members 16, 18 and base frame 20 may have various configurations and may be fabricated from various materials so long as they are capable of supporting control panel 12.

A treadbase 22 is connected to support structure 14 and typically includes front and rear pulleys 24, 26 connected between opposing side rails 25, 27. A continuous belt 28 extends between and around front and rear pulleys 24, 26, respectively. Treadbase 22, front and rear pulleys 24, 26, and continuous belt 28 may be considered, individually or collectively, as movable elements that are movable during the performance of an exercise. A deck 30 is also connected between opposing side rails 25, 27 and supports the upper run of belt 28 and an exercising individual positioned upon belt 28. One example manner of connecting deck 30 to side rails 25, 27 is discussed below in connection with FIG. 5.

As is common with electric treadmills, at least one of front pulley 24 and rear pulley 26 may be mechanically connected to an electric belt drive motor 32. Belt drive motor 36 turns front or rear pulley 24, 26 in order to rotate belt 28. Belt drive motor 32 is electrically connected to a controller 34 that controls the operation of belt drive motor 32, and thus the speed of belt 28, in response to various inputs. The speed of belt 28 is one example of an adjustable operating parameter of exercise device 10.

Controller 34 can be incorporated within treadbase 22, control panel 12, or another portion of exercise device 10. Controller 34 may take the form of a computer, a processor, a microprocessor, a microcontroller, state machine or other similar device that includes circuitry for controlling the operation of one or more features on exercise device 10, including the operating parameter(s) of the movable element(s). Controller 34 may also include one or more computer readable media or devices that have computer executable instructions stored thereon.

In addition to the ability to control and vary the speed of belt 28, exercise device 10 may optionally permit the degree of incline of treadbase 22 relative to base frame 20, the floor, or other support surface upon which exercise device 10 rests, to be varied. For instance, treadbase 22 can be oriented in a neutral position, an inclined position, or a declined position. In the neutral position, treadbase 22 is generally parallel to the support surface. In the inclined position, the front portion of treadbase 22 (e.g., the end of treadbase 22 adjacent to support structure 14) is vertically higher than the rear portion of treadbase 22 to enable an exerciser to simulate walking or running up a hill. Similarly, in a declined position the front portion of treadbase 22 is vertically lower than the rear portion of treadbase 22 to enable an exerciser to simulate walking or running down a hill.

The inclining and declining capabilities of treadbase 22 provide exercise device 10 with additional operating parameters that may be adjusted to vary the intensity of exercises performed on exercise device 10. The inclination and declination of treadbase 22 can be accomplished through the use of various inclination mechanisms. As shown in FIG. 2, one example inclination mechanism includes an extension mechanism 36 connected between base frame 20 and treadbase 22. Extension mechanism 36 includes an incline motor 38 that may be controllable by controller 34 to cause an extension member 40 of extension mechanism 36 to extend or retract in order to move treadbase 22 between the declined, neutral, and inclined positions.

Exercise device 10 may also have the capability to vibrate certain portions of exercise device 10. For instance, as shown in FIG. 2, two vibration assemblies 42, 44 are mounted to treadbase 22. More specifically, vibration assemblies 42, 44 are mounted to the underside of deck 30. In the illustrated embodiment, vibration assemblies 42, 44 are positioned towards opposing sides of deck 30 about half way between front and rear pulleys 24, 26. When activated, vibration assemblies 42, 44 cause deck 30 to vibrate.

Figure 3:
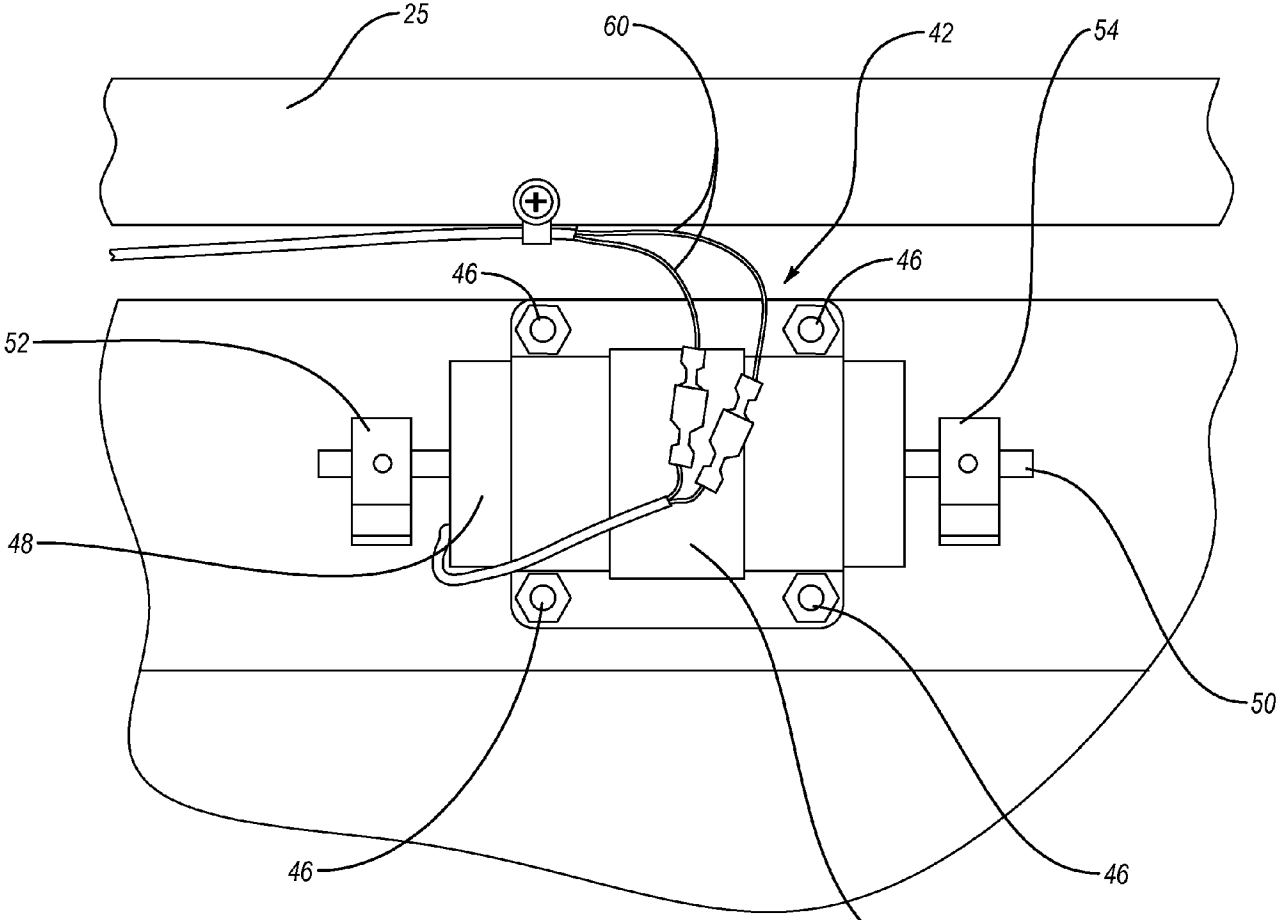
FIG. 3 is a close up view of a vibration assembly connected to the exercise device of FIG. 1.
Figure 4:
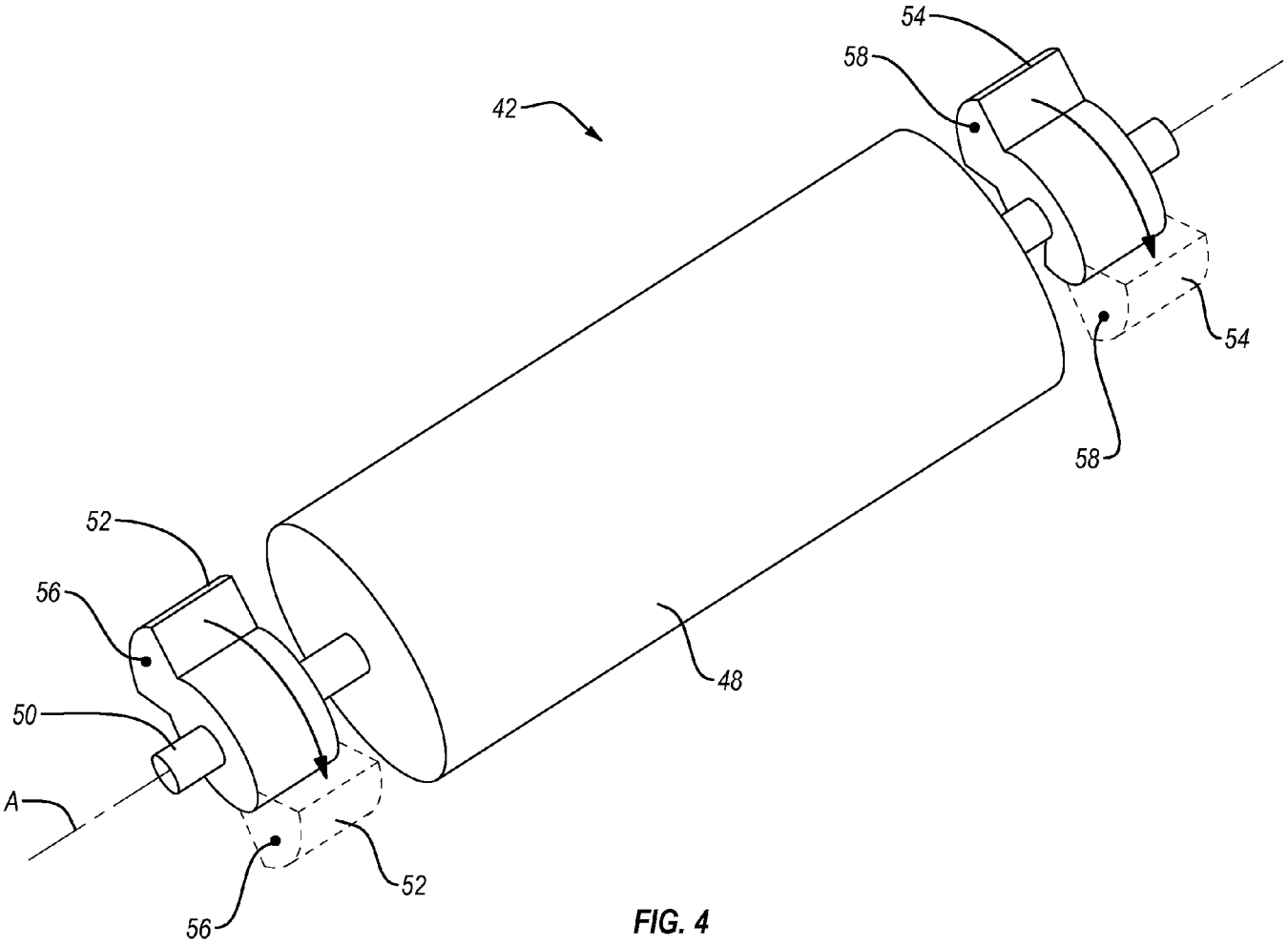
FIG. 4 illustrates the vibration assembly of FIG. 3 separate from exercise device of FIG. 1.

FIGS. 3 and 4 illustrate vibration assembly 42 in greater detail. It is understood that vibration assembly 44 may be similar or identical to vibration assembly 42. Accordingly, the following discussion of vibration assembly 42 is equally applicable to vibration assembly 44. In FIG. 3, vibration assembly 42 is shown mounted to the underside of deck 30. In FIG. 4, vibration assembly 42 is shown separate from exercise device 10. As can be seen in FIG. 3, vibration assembly 42 is connected to deck 30 with a bracket 45 and bolts 46.

According to the illustrated embodiment, vibration assembly 42 includes a motor 48, a shaft 50, and eccentric weights 52, 54. Shaft 50 extends through motor 48 such that motor 48 is able to rotate shaft 50 about a longitudinal axis A of shaft 50. Each of eccentric weights 52, 54 has a center of mass that is offset from shaft 50 and axis A. For instance, eccentric weights 52, 54 may have centers of mass 56, 58, respectively.

In the illustrated embodiment, eccentric weights 52, 54 are fixedly mounted on opposing ends of shaft 50. As a result, when shaft 50 is rotated by motor 48, eccentric weights 52, 54 likewise rotate about axis A. For instance, in FIG. 4, eccentric weights 52, 54 are shown in solid lines in a first position. Eccentric weights 52, 54 are also shown in dashed lines in a second position after eccentric weights 52, 54 are rotated partially about axis A. As can be seen, as eccentric weights 52, 54 rotate, centers of mass 56, 58 revolve about axis of rotation A. The movement of centers of mass 56, 58 about axis A causes vibration assembly 42 to vibrate. Because vibration assemblies 42, 44 are mounted to deck 30, the vibrations from vibration assemblies 42, 44 are transferred to deck 30, thereby causing deck 30 to vibrate.

The intensity and frequency of the vibration is a result of a number of different variables, including the speed at which the eccentric weights 52, 54 rotate, the distance between axis A and centers of mass 56, 58, and the size of eccentric weights 52, 54. The intensity and/or frequency of the vibrations can be increased by increasing the rotational speed of eccentric weights 52, 54, increasing the distance between axis A and centers of mass 56, 58, and/or increasing the size of eccentric weights 52, 54. Conversely, the intensity and/or frequency of the vibrations can be decreased by decreasing the rotational speed of eccentric weights 52, 54, decreasing the distance between axis A and centers of mass 56, 58, and/or decreasing the size of eccentric weights 52, 54.

Vibration assemblies 42, 44 may also be connected to controller 34 and/or control panel 12. For instance, as shown in FIG. 3, vibration assembly 42 is connected to controller 34 and/or control panel 12 via wires 60. Connecting vibration assembly 42 to controller 34 enables controller 34 to control the operation of vibration assembly 42, including such things as turning vibration assembly 42 on an off, controlling the speed at which eccentric weights 52, 54 are rotated, and which direction eccentric weights 52, 54 are rotated. Similarly, connecting vibration assembly 42 to control panel 12 enables a user of exercise device 10 to selectively control the operation of vibration assembly 42 at control panel 12. For instance, a user may activate one or more inputs on control panel 12 to turn vibration assembly 42 on or off, adjust the speed at which eccentric weights 52, 54 are rotated, and/or alter the direction eccentric weights 52, 54 rotate.

Figure 5:
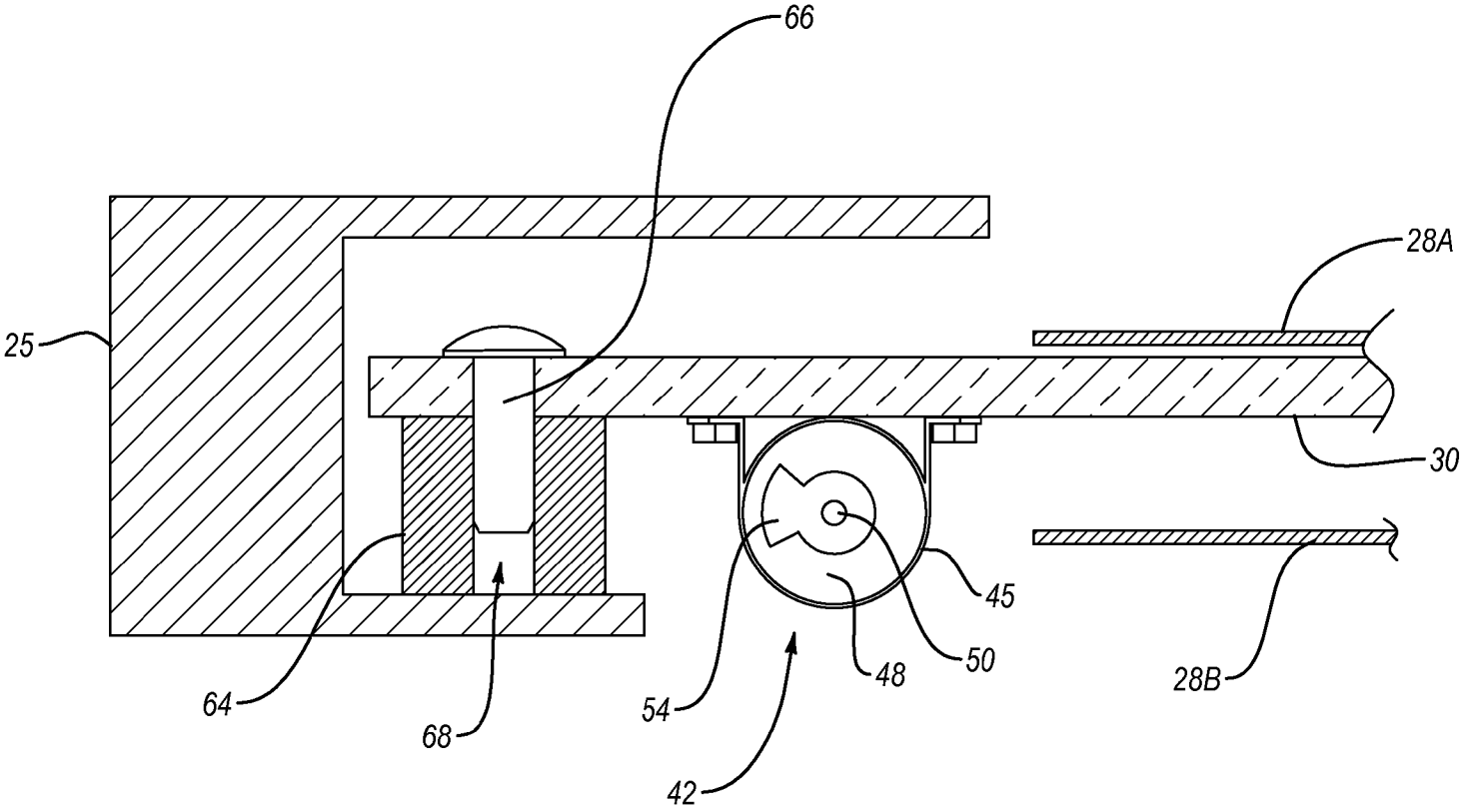
FIG. 5 illustrates a partial cross-sectional view of the exercise device of FIG. 1 showing an exemplary connection between a deck and side rails.

FIG. 5 illustrates a partial cross-sectional view of treadbase 22 to show one example manner of connecting deck 30 to side rails 25, 27. In FIG. 5, one connection between deck 30 and side rail 25 is illustrated. It is understood, however, that multiple similar or identical connections may be made between deck 30 and side rails 25, 27.

As shown in FIG. 5, an upper run 28A of continuous belt 28 is positioned above deck 30 and a lower run 28B of continuous belt 28 is positioned underneath deck 30. Additionally, vibration assembly 42 is mounted to the underside of deck 30 and to the side of lower run 28B. As also shown, an isolator 64 is positioned between deck 30 and side rail 25. More specifically, side rail 25 includes an upwardly facing surface upon which isolator 64 is mounted. Isolator 64 may be fixedly mounted on side rail 25 so that isolator 64 does not move laterally relative to side rail 25.

Deck 30 is positioned on top of isolator 64. Isolator 64 is formed of a material that is resilient and at least slightly compressible or deformable. Accordingly, when a downward force is applied to deck 30, deck 30 moves slightly downward, which causes isolator 64 to be temporarily compressed or deformed to absorb the downward force applied to deck 30. In this way the movements of deck 30 are substantially isolated from side rails 25, 27. Additionally, the vibrations transferred to deck 30 from vibration assemblies 42, 44 are focused into deck 30 and are not transferred to side rails 25, 27 or other parts of exercise device 10. As a result, smaller vibration assemblies can be used to vibrate deck 30 without having to vibrate all of treadbase 22 ore exercise device 10.

A guide pin 66 is connected to deck 30 and extends downwardly from deck 30 and into a bore 68 in isolator 64. Guide pin 66 is movable relative to isolator 64 such that guide pin 66 slides up and down in bore 68 when deck 30 moves up and down. Additionally, guide pin 66 and bore 68 cooperate to substantially maintain the lateral position of deck 30 relative to side rails 25, 27.

Figure 6:
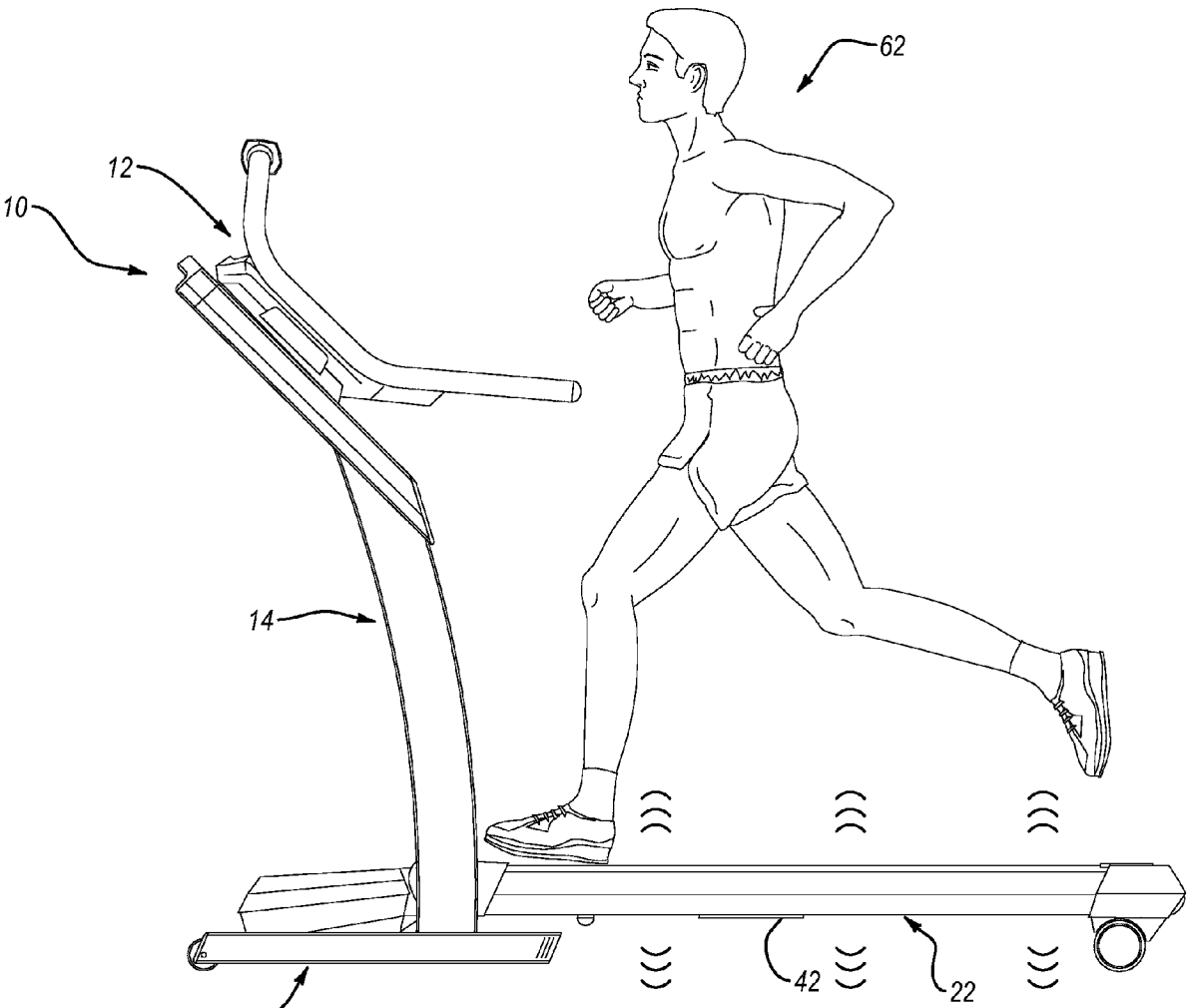
FIG. 6 illustrates a user performing an exercise on the exercise device of FIG. 1.
Figure 7:
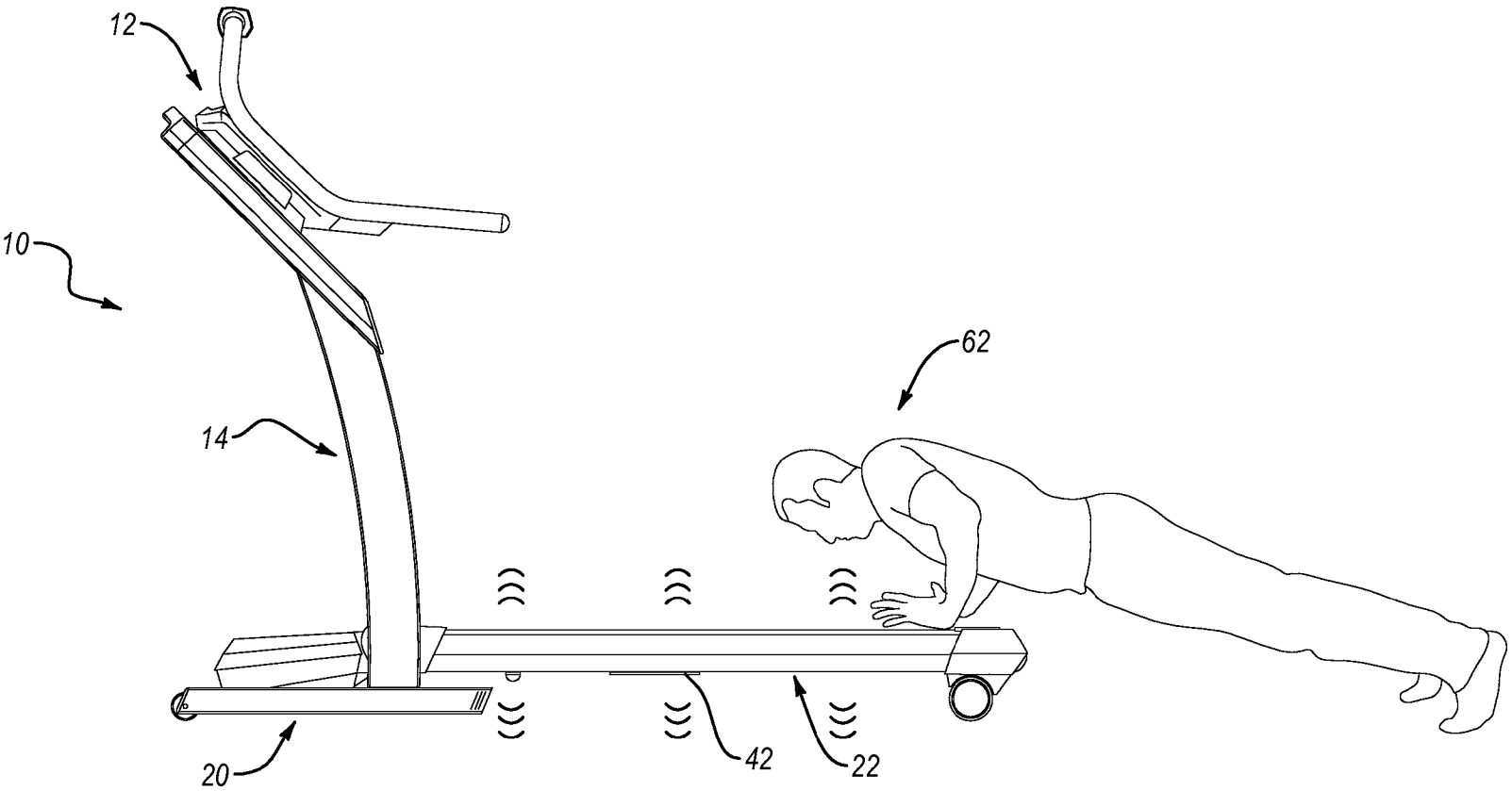
FIG. 7 illustrates a user performing another exercise on the exercise device of FIG. 1.
Figure 8:
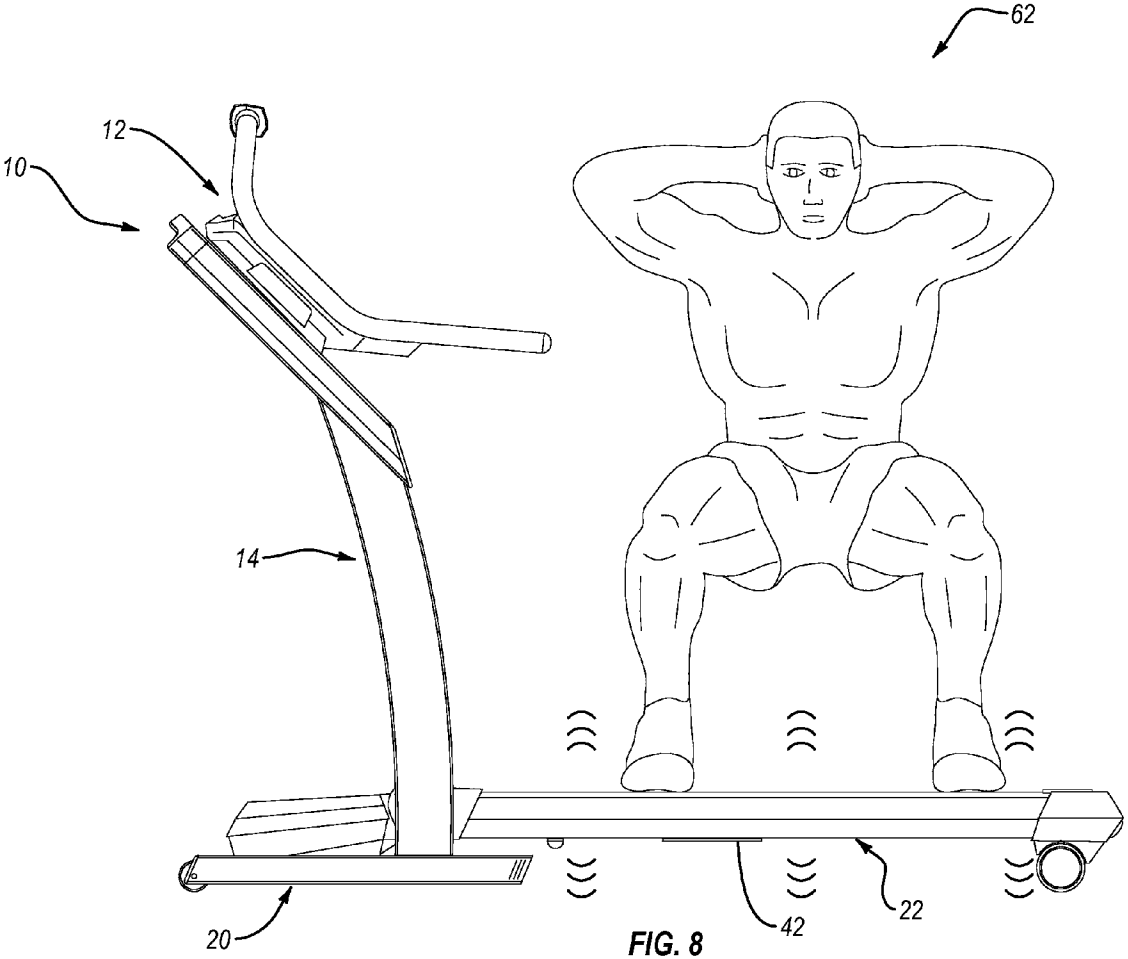
FIG. 8 illustrates a user performing still another exercise on the exercise device of FIG. 1.

Attention is now directed to FIGS. 6-8 which illustrate example exercises that may be enhanced by the vibrating capabilities of exercise device 10. In FIG. 6, for example, a user 62 is jogging on exercise device 10. More specifically, user 62 is jogging on treadbase 22. As noted, activation of vibration assemblies 42, 44 causes vibration assemblies 42, 44 and, in turn, deck 30 to vibrate, as illustrated with the vibration lines above and below treadbase 22. As user 62 walks, jogs, or runs on treadbase 22, the vibrations are transferred to user 62.

In addition to enhancing typical exercises performed on treadmills (e.g., running, jogging, walking) with vibrations, the vibrations provided by vibration assemblies 42, 44 can also enhance other types of exercises. For instance, FIG. 7 illustrates user 62 performing pushups on exercise device 10. More specifically, user 62 has his hands placed on treadbase 22 and his feet on the floor. In this position, user 62 can raise and lower his upper body relative to treadbase 22 in order to perform the pushups. When user 62 performs pushups this way and with vibration assemblies 42, 44 activated, the vibrations created by vibration assemblies 42, 44 are transferred through deck 30 and into the arms of user 62. Similarly, as shown in FIG. 8, user 62 may perform squats on treadbase 22. When vibration assemblies 42, 44 are activated, the vibrations created by vibration assemblies 42, 44 are transferred through deck 30 and into the legs of user 62.

INDUSTRIAL APPLICABILITY

In general, embodiments of the present disclosure relate to systems and devices that impart vibrations to a user's body. More particularly, the systems and devices of the present disclosure impart vibrations to a user's body during the performance of an exercise. The exercise and the imparted vibrations can provide numerous benefits to the user, including aerobic conditioning, improved muscle strength and performance, increased bone density, stamina, flexibility, mobility, and coordination, enhanced critical blood flow throughout the body, relief of aches and pains, enhanced explosive strength, accelerated weight loss, decreased cortisol levels, increased production of serotonin and neurothrophine, and improved injury recovery.

The systems and devices of the present disclosure may include an exercise device in the form of a treadmill. The treadmill may include an upright support structure that supports a control panel. A treadbase may be connected to the upright support structure and designed to allow a user to perform various exercises thereon.

More specifically, the treadbase may include opposing side rails, a deck connected to the side rails, front and rear pulleys connected between the side rails and disposed at opposing ends of the deck, and a continuous belt trained around the front and rear pulleys. The deck may support a user positioned on top of the continuous belt. The continuous belt may be rotated about the front and rear pulleys to enable the user to walk, job, or run on the treadbase. Alternatively, the continuous belt may remain stationary while the user performs other types of exercises on the treadbase, such as pushups, squats, sit-ups, and the like.

In addition to enabling a user to perform various types of exercises on the treadbase, the systems and devices of the present disclosure may also include one or more vibration assemblies that create vibrations that are imparted to the user during the performance of the various exercises. Each of the one or more vibration assemblies may include a motor, such as a rotary motor, that rotates a shaft about an axis of rotation. The axis of rotation may be generally parallel to or collinear with a longitudinal axis of the shaft. One or more eccentric weights may be mounted on the shaft such that rotation of the shaft causes the one or more eccentric weights to rotate about the axis of rotation. Each of the one or more eccentric weights may have a center of mass that is offset from the axis of rotation. As a result of the offset between the centers of mass and the axis of rotation, rotation of the one or more eccentric weights creates vibrations. In other embodiments, the vibration assembly motor may directly rotate the one or more eccentric weights without requiring the weights to be mounted on a shaft.

The one or more vibration assemblies may be connected to the treadbase such that the vibrations created by the one or more vibration assemblies are transferred to the treadbase. For instance, the one or more vibration assemblies may be rigidly connected to the deck of the treadbase. In some embodiments the deck is isolated from the rest of the treadbase such that the vibrations are not transferred from the deck to the rest of the treadbase. For instance, the deck may be connected to the side rails with one or more isolators that limit or prevent the transfer of vibrations from the deck to the side rails. In other embodiments, however, the deck may be connected to the side rails in such a way to allow for the vibrations to be transferred to the side rails. In still other embodiments, the one or more vibration assemblies may be connected to the one or more side rails and the vibrations from the one or more vibration assemblies may be transferred to the deck by way of the one or more side rails. In some embodiments, such as when the side rails and/or the entirety of the treadbase are vibrated by the vibration assemblies, the treadbase may be isolated from the support structure to limit or prevent the vibrations from being transferred from the treadbase to the support structure.

In addition or as an alternative to having rotating eccentric weights that create vibrations, the one or more vibration assemblies may include one or more rotating cams or other movable members that periodically engage, hit, or tap the deck of the treadbase or the one or more side rails in order to create the vibrations in the deck.

Various numbers and arrangements of vibration assemblies can be used with the systems and devices of the present disclosure. For instance, one or more vibration assemblies may be used to impart vibrations to the deck of the treadbase. The number of vibration assemblies used may depend on the size of the vibration assemblies used and/or the placement of the vibration assemblies on the exercise device.

For instance, one relatively large vibration assembly may be connected to the underside of the deck near the center of the deck. This arrangement may allow for the vibrations to spread through the deck in all directions. Alternatively, two vibration assemblies may be connected to and near opposing sides of the deck about midway between the front and rear ends of the deck. Either of these arrangements may provide the greatest amount of vibration to be concentrated in the area of the treadbase deck where the user is most likely to make the most contact with the deck. In other words, since the vibrations will likely diminish further away from the one or more vibration assemblies, locating the one or more vibration assemblies near the area of the deck that the user contacts the most provides the greatest amount of vibration to the user. Nevertheless, other arrangements of vibration assemblies may be used. For instance, a vibration assembly may be connected to each of the four corners of the deck.

In cases where multiple vibration assemblies are used, the vibration assemblies may be coordinated with one another to create vibrations with desired characteristics. For instance, the rotational speed and/or direction of the vibration assemblies may be coordinated to create vibrations with desired intensities and/or frequencies. More specifically, the rotational speed and/or direction of each vibration assembly may be controlled to generate the desired vibrations where the user contacts the deck of the treadbase. In other words, the rotational speed and/or direction of each vibration assembly may be controlled so that the vibrations from each vibration assembly either add to or partially cancel the vibrations from the other vibration assemblies.

In addition to the above-noted physiological benefits, adding vibration to the disclosed devices can increase the enjoyment associated with using the disclosed devices. For instance, a user that walks or runs on a typical treadmill may find it uncomfortable or boring to walk or run on a hard, flat surface. In contrast, vibrating the deck of the treadbase can provide a sensation to the user that is similar to walking or running on a trail or cobblestone as well as providing a softer impact for the user's steps.

In some embodiments, the intensity and/or frequency of the vibrations may be tied to other operating parameters of the exercise device. By way of non-limiting example, the intensity and/or frequency of the vibrations may be tied to speed of the continuous belt or the incline of the treadbase. For instance, the intensity and/or frequency of the vibrations may increase as the speed of the continuous belt increases and vice versa. Similarly, the intensity and/or frequency of the vibrations may increase or decrease as the incline of the treadbase increases or decreases.

What is claimed is:

1. A treadmill, comprising:

a treadbase having a first end, a second end, a first side, and a second side, the treadbase comprising:

first and second opposing side rails extending along at least a portion of the first and second sides of the treadbase, respectively;

a deck connected to and between the first and second opposing side rails;

front and rear pulleys connected to and between the first and second opposing side rails;

a continuous belt trained around and rotatable about the front and rear pulleys;

one or more vibration assemblies connected to the deck, wherein the one or more vibration assemblies selectively create vibrations to cause the deck to vibrate; and a first isolator connected between the deck and the first side rail and a second isolator connected between the deck and the second opposing side rail to limit the transfer of vibrations from the deck to the first and second opposing side rails;

wherein the first and second isolators are made of a slightly compressible or deformable material that absorbs downward forces applied to the deck; and wherein an intensity or frequency of the vibrations created by the one or more vibration assemblies is related to at least one of a speed of the continuous belt or an incline level of the treadbase.

2. The treadmill of claim 1, wherein the one or more vibration assemblies comprise a first vibration assembly and a second vibration assembly, the first vibration assembly being connected to the deck adjacent the first side of the treadbase about midway between the first and second ends of the treadbase, and the second vibration assembly being connected to the deck adjacent the second side of the treadbase about midway between the first and second ends of the treadbase.

3. The treadmill of claim 1, wherein at least one of the first and second isolators comprises a bore extending at least partially therethrough, and wherein a guide pin extends from the deck and into the bore.

4. The treadmill of claim 1, wherein the one or more vibration assemblies are connected to the deck between the first and second isolators and the continuous belt.

5. The treadmill of claim 1, wherein at least one of the one or more vibration assemblies comprises a motor, a shaft rotatable by the motor about an axis of rotation, and one or more eccentric weights mounted on the shaft.

6. The treadmill of claim 5, wherein each of the one or more eccentric weights comprises a center of mass that is offset from the axis of rotation.

7. The treadmill of claim 6, wherein rotation of the shaft about the axis of rotation causes the centers of mass of the one or more eccentric weights to revolve around the axis of rotation, thereby creating the vibrations.

8. The treadmill of claim 7, wherein an intensity or frequency of the vibrations is selectively controlled by adjusting the speed at which the centers of mass of the one or more eccentric weights revolve around the axis of rotation.

9. The treadmill of claim 1, further comprising a control panel having one or more user inputs, the control panel being in electrical communication with the one or more vibration assemblies such that the one or more vibration assemblies are controllable by activating the one or more user inputs.

10. The treadmill of claim 1, wherein the treadbase is selectively movable between a plurality of inclined positions, including a declined position, a neutral position, and an inclined position.

11. The treadmill of claim 1, wherein the one or more vibration assemblies comprise four vibration assemblies, each of the four vibration assemblies being connected adjacent to a corn er of the deck.

12. The treadmill of claim 1, wherein the one or more vibration assemblies comprise a vibration assembly connected to an underside of the deck near the center of the deck.

13. The treadmill of claim 1, wherein at least one of the first side rail and the second opposing side rail includes an upwardly facing surface upon which at least one of the first isolator and the second isolator is mounted.

14. A treadmill, comprising:

a support structure;

a control panel mounted on the support structure; and a treadbase connected to the support structure, the treadbase having a first end, a second end, a first side, and a second side, the treadbase comprising:

first and second opposing side rails extending along at least a portion of the first and second sides of the treadbase, respectively;

a deck connected to and between the first and second opposing side rails, wherein a first isolator is disposed between the deck and the first side rail and a second isolator is disposed between the deck and the second opposing side rail to limit the transfer of vibrations from the deck to the first and second opposing side rails;

wherein the first and second isolators are made of a slightly compressible or deformable material that absorbs downward forces applied to the deck;

front and rear pulleys connected to and between the first and second opposing side rails;

a continuous belt trained around and rotatable about the front and rear pulleys; and one or more vibration assemblies connected to the deck, wherein the one or more vibration assemblies selectively create vibrations to cause the deck to vibrate, at least one of the one or more vibration assemblies comprising:

a motor, a shaft rotatable by the motor about an axis of rotation; and one or more eccentric weights fixedly mounted on the shaft such that rotation of the shaft causes the one or more eccentric weights to rotate about the axis of rotation, each of the one or more eccentric weights comprising a center of mass that is radially offset from the axis of rotation; and wherein an intensity or frequency of the vibrations created by the one or more vibration assemblies is related to at least one of a speed of the continuous belt or an incline level of the treadbase.

15. The treadmill of claim 14, wherein the one or more vibration assemblies comprise:

a first vibration assembly connected to the deck adjacent the first side of the treadbase about midway between the first and second ends of the treadbase; and a second vibration assembly connected to the deck adjacent the second side of the treadbase about midway between the first and second ends of the treadbase.

16. The treadmill of claim 14, wherein at least one of the one or more vibration assemblies is connected to the deck with a bracket.

* * * * *